US005964106A

United States Patent [19]

Shibata et al.

[11] Patent Number: 5,964,106

[45] Date of Patent: Oct. 12, 1999

[54] YARN FEEDING AND CHANGING MECHANISM FOR A CIRCULAR KNITTING MACHINE

[75] Inventors: Takao Shibata, Osaka; Haruka Sakamoto, Hyogo, both of Japan

[73] Assignee: Precision Fukuhara Works, Ltd, Japan

[21] Appl. No.: 09/019,388

[22] Filed: Feb. 5, 1998

[30] Foreign Application Priority Data

Feb. 19, 1997 [JP] Japan ..... 9-052354

[51] Int. Cl.[6] ..... D04B 15/60

[52] U.S. Cl. ..... 66/140 R

[58] Field of Search ..... 66/140 R

[56] References Cited

U.S. PATENT DOCUMENTS

| | | | |
|---|---|---|---|
| 2,773,372 | 12/1956 | Shelmire | 66/140 R |
| 3,733,858 | 5/1973 | Gasparri | 66/140 R |
| 4,099,392 | 7/1978 | Lonati | 66/140 R |
| 4,404,821 | 9/1983 | Johnson et al. | 66/140 R |
| 4,656,842 | 4/1987 | Sawazaki et al. | 66/140 R |
| 5,046,333 | 9/1991 | Sawazaki et al. | 66/140 R |
| 5,251,463 | 10/1993 | Lonati et al. | 66/140 R |

*Primary Examiner*—Andy Falik
*Attorney, Agent, or Firm*—Alston & Bird LLP

[57] ABSTRACT

Yarn feeding and changing mechanism for circular knitting machine includes a plurality of yarn feed fingers selectively movable between operative and inoperative positions to feed yarn to the needles only when in operative position. A first rocking jack is connected to each yarn feed finger for moving the yarn feed fingers between operative and inoperative positions, and a slider member is connected to each first rocking jack. A second rocking jack is connected to each slider member and a plurality of pivotable selection members are provided for imparting rocking movement to the second rocking jacks in a predetermined pattern. The yarn feed fingers are thus moved from the operative to the inoperative position while a yarn catcher and cutter catches the yarn and cuts the yarn to form a free end which is held while the yarn feed finger is moved to the inoperative position, is in the inoperative position and is moved to the operative position by way of an extended position to present the held free end portion of the yarn to the needles for knitting into the fabric instead of being cut into waste.

25 Claims, 8 Drawing Sheets

YARN FEEDING AND CHANGING MECHANISM FOR A CIRCULAR KNITTING MACHINE

FIELD OF THE INVENTION

The present invention relates to circular knitting machines and more particularly to yarn feeding and changing mechanisms for circular knitting machines.

BACKGROUND OF THE INVENTION

Circular knitting machines produce tubular knitted fabric from yarns fed to knitting needles carried by a rotating needle cylinder. Typically, there are multiple stationary yarn feeding mechanisms around the periphery of the needle cylinder for feeding yarns to the needles as the cylinder rotates and the needles move past each yarn feeding mechanism.

For various and sundry reasons, it is desirable to provide multiple yarns having different characteristics at each of the multiple yarn feeding mechanisms and to change the particular yarn being fed to the needles from time-to-time. Accordingly, such yarn feeding mechanisms have heretofore been developed with a plurality of yarn feed fingers movable between operative and inoperative positions and each carrying a different yarn. A selection device is included and selectively moves the plurality of yarn feed fingers between the operative and inoperative positions in accordance with a predetermined pattern.

Such prior yarn feeding mechanisms have heretofore included yarn cutting means for cutting the yarns whose yarn feed fingers are moved to the inoperative positions and for capturing and holding the free ends thereof until such yarn feed fingers are moved to the operative positions and the yarns are again knit into the fabric being formed. Heretofore, the yarn changing process has resulted in waste lengths of yarn cut from the yarns being changed. Such waste lengths of yarn must be disposed of and prior yarn changing mechanisms have included suction nozzles and conduits for such waste disposal. One example of such a yarn changing mechanism is disclosed in Japanese patent application Ser. No. 175,243/89, filed Jul. 5, 1989 (Japanese Patent Laid-Open No. 40,848/91).

The generation of the waste lengths of yarn and the requisite disposed thereof is undesirable and has been a substantial disadvantage and deficiency of prior yarn changing mechanisms.

SUMMARY OF THE INVENTION

With the foregoing in mind, it is an object of the present invention to provide a yarn changing mechanism for circular knitting machines that does not generate waste lengths of yarn and therefore obviates the disadvantages and deficiencies of prior yarn changing mechanisms.

This object of the present invention is accomplished by providing a yarn changing mechanism in which a plurality of yarn feed fingers are movable between operative and inoperative positions, yarn cutting means is provided and cuts the yarns when the yarn feeding fingers are moved to the inoperative positions and yarn catching means catches the cut free end of the yarn and holds the end of the yarn in spaced relation to the yarn feed finger.

When that yarn feed finger is moved from the inoperative position to the operative position, the yarn feed finger is moved past the operative position so that the free end portion of the yarn is caught by the needles and the free end portion of the yarn is released by the yarn catching means and such free end of the yarn is knit into the knit fabric rather than having it cut into a waste length of yarn. The yarn feed finger is moved back to the operative position once the free end portion of the yarn is caught by the needles.

BRIEF DESCRIPTION OF THE DRAWINGS

Some of the objects and advantages of the present invention having been stated, others will appear as the description proceeds when considered in conjunction with the accompanying schematic drawings in which.

DETAILED DESCRIPTION OF THE PREFERRED EMBODIMENTS

Figure 1:
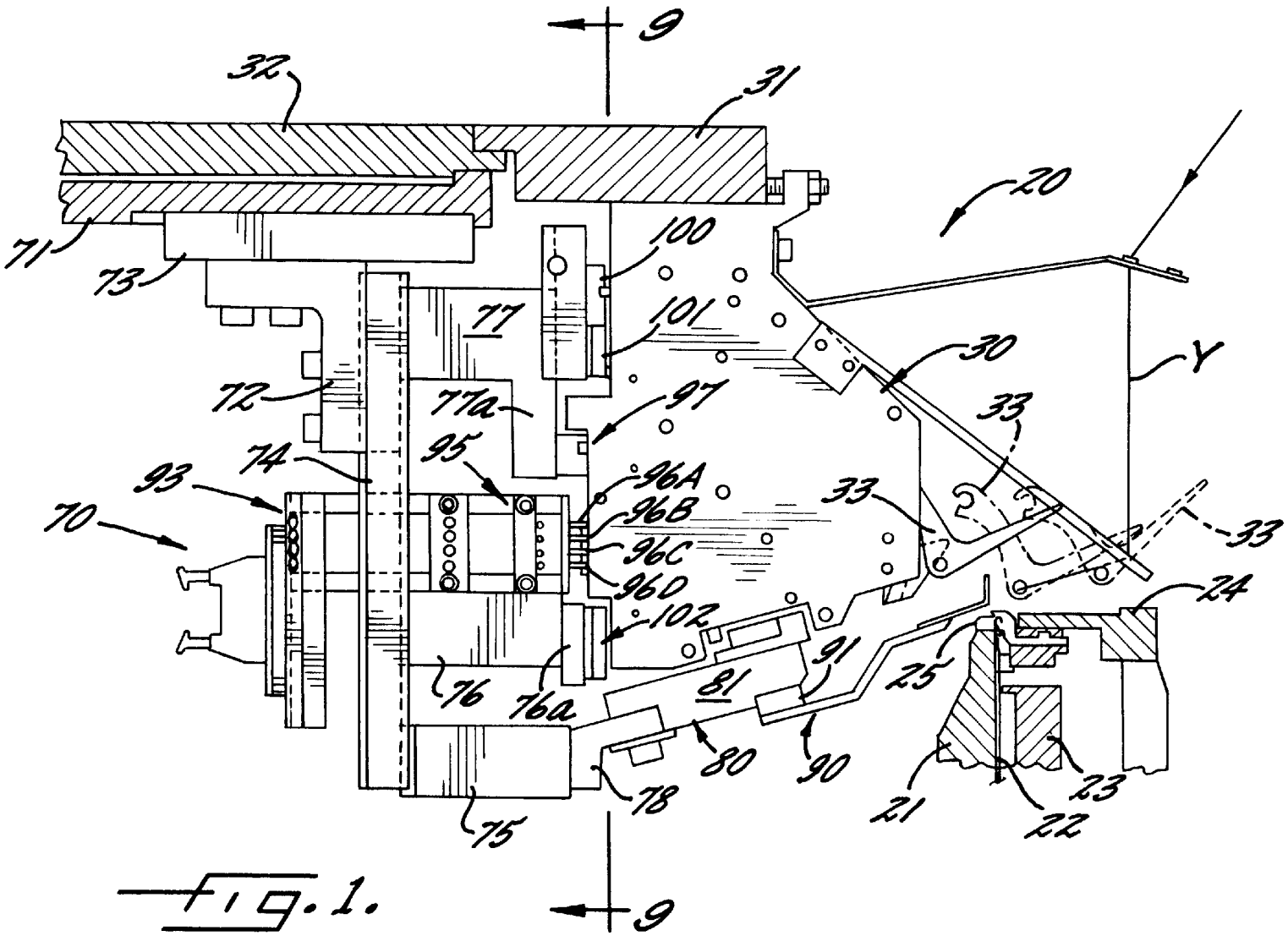
FIG. 1 is a fragmentary elevational view, partially in section, of a circular knitting machine having the yarn feeding and changing mechanism of the present invention thereon.

Referring now more specifically to the drawings and particularly to FIG. 1, there is illustrated a circular knitting machine, generally indicated at 20, incorporating the features of the present invention. Circular knitting machine 20 includes a needle cylinder 21 having a multiplicity of knitting needles 22 slidably mounted in vertical grooves around the periphery of cylinder 21. As is common, cylinder 21 rotates about its axis and needles 22 are operated by stitch cams (not shown) mounted on a cam block 23.

A sinker cap 24 is mounted adjacent cylinder 21 and outwardly thereof and has a multiplicity of sinkers 25 movable outwardly and inwardly relative to needles 22. Sinkers 25 cooperate with needles 22 to form knit stitches from yarns Y to produce the knit fabric.

A yarn feeding and changing mechanism generally indicated at 30 is located inside the cylinder 21 and is supported by an outer support plate 31. Support plate 31 is in turn supported by a circular plate 32.

Yarn feeding and changing mechanism 30 includes a plurality of yarn feed fingers 33 (only one of which is shown), each of which carry a yarn Y. It is contemplated that the number of yarn feed fingers 33 included in the yarn feeding and changing mechanism 30 may vary as the number of different yarns to be fed to the needles 22 vary. One example would be a yarn feeding and changing mechanism 30 having four such yarn feed fingers 33.

Each yarn feed finger 33 is movable from an inoperative position (shown in solid lines in FIG. 1) to an extended position (shown in broken lines in FIG. 1) and then back from the extended position to an operative position (shown in phantom lines in FIG. 1). In the inoperative position of yarn feed finger 33, the yarn Y is not fed to the needles 22. In the extended position, the needles 22 capture the free end portion of the yarn Y and in the operative position, the yarn Y is fed to the needles 22.

Each yarn feed finger 33 has a yarn guide eyelet 33*a* therein through which the yarn Y passes. Each yarn feed finger 33 is mounted for sliding movement in a guide slot 34*a* of a finger guide member 34 (FIG. 2) by a pin 34*b* mounted on the finger guide member 34 and passing through an elongated, predeterminedly configured or profiled slot 33*b* in the yarn feed finger 33. The configuration or profile of the slot 33*b* is such that the yarn feed finger 33 not only moves outwardly and inwardly relative to the needles 22, but also moves downwardly upon outward movement and upwardly upon inward movement.

Each yarn feed finger 33 is connected at its inner end 33*c* to a first rocking jack 35 by a socket 33*d* in end 33*c* of the yarn feed finger 33 and a ball 35*a* on the first rocking jack 35. First rocking jack 35 is pivotally mounted by a pivot pin 36 and includes a first arm 35*b* which has ball 35*a* at its outer end, a second arm 35*c* having a ball 35*d* at its outer end and a third arm 35*e*.

Each of the first rocking jacks 35 is connected to a slider member 37 by a socket 37*a*, in the outer end of a projection 37*b* extending outwardly from approximately the midportion of slider member 37, which receives the ball 35*d* on the second arm 35*c* of first rocking jack 35 therein. Each slider member 37 is mounted for vertical sliding movement in a groove 38*a* in a slider guide member 38. Each slider member 37 has an upper portion 37*c* extending upwardly from the projection 37*b* to the upper end of slider member 37 and a lower portion 37*d* extending downwardly from the projection 37*b* to the lower end of slider member 37. The upper and lower portions 37*c* and 37*d*, respectively, have cavities 37*e*, 37*f* and 37*g*, 37*h* in the side thereof from which projection 37*b* extends. A pair of detents 40 and 41 are mounted in slider guide member 38 and include balls 40*a* and 41*a* and springs 40*b* and 41*b*. The balls 40*a* and 41*a* are received respectively in one of the cavities 37*e*, 37*f* and 37*g*, 37*h* to hold releasably the slider member 37 in one of two positions.

Third arm 35*e* of first rocking jack 35 carries a claw 42 pivotally mounted thereon by a pin 43. A spring 44 is mounted on third arm 35*e* by a pin 45 and has one end portion 44*a* engaging second arm 35*c* and the other end portion 44*b* engaging the claw 42 to bias the claw 42 downwardly about pin 43. Claw 42 has a downwardly extending projection 42*a* for reasons to be described presently.

Each slider member 37 has a socket 37*j* in the side thereof opposite the projection 37*b* which receives a ball 46*a* on a second rocking jack 46. Each second rocking jack 46 is mounted for rocking movement in the same groove 38*a* in the slider guide member 38 that the slider member 37 occupies.

Figure 2:
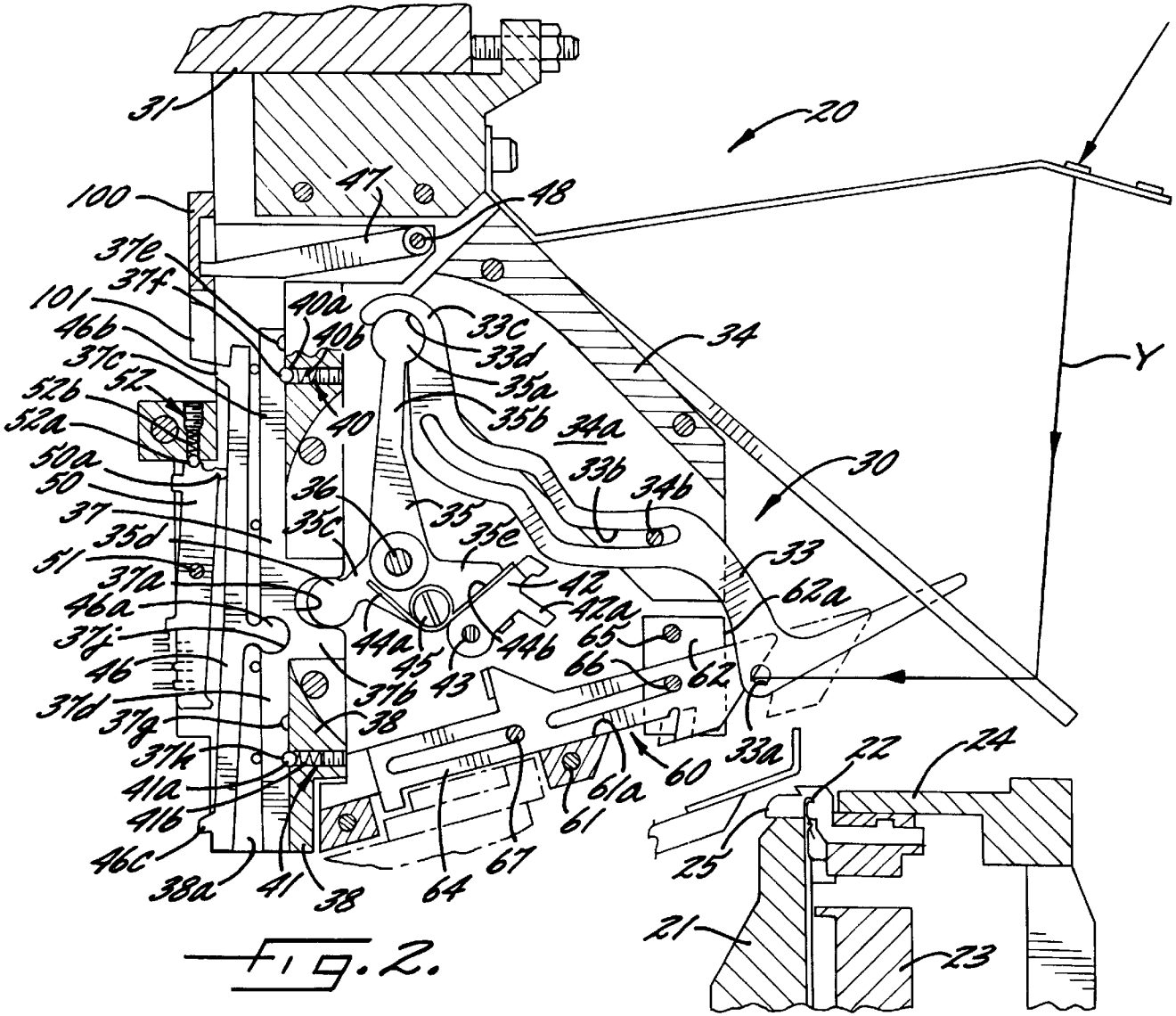
FIG. 2 is an enlarged fragmentary elevational view, partially in section, of a circular knitting machine with the yarn changing mechanism illustrated in FIG. 1.
Figure 3:
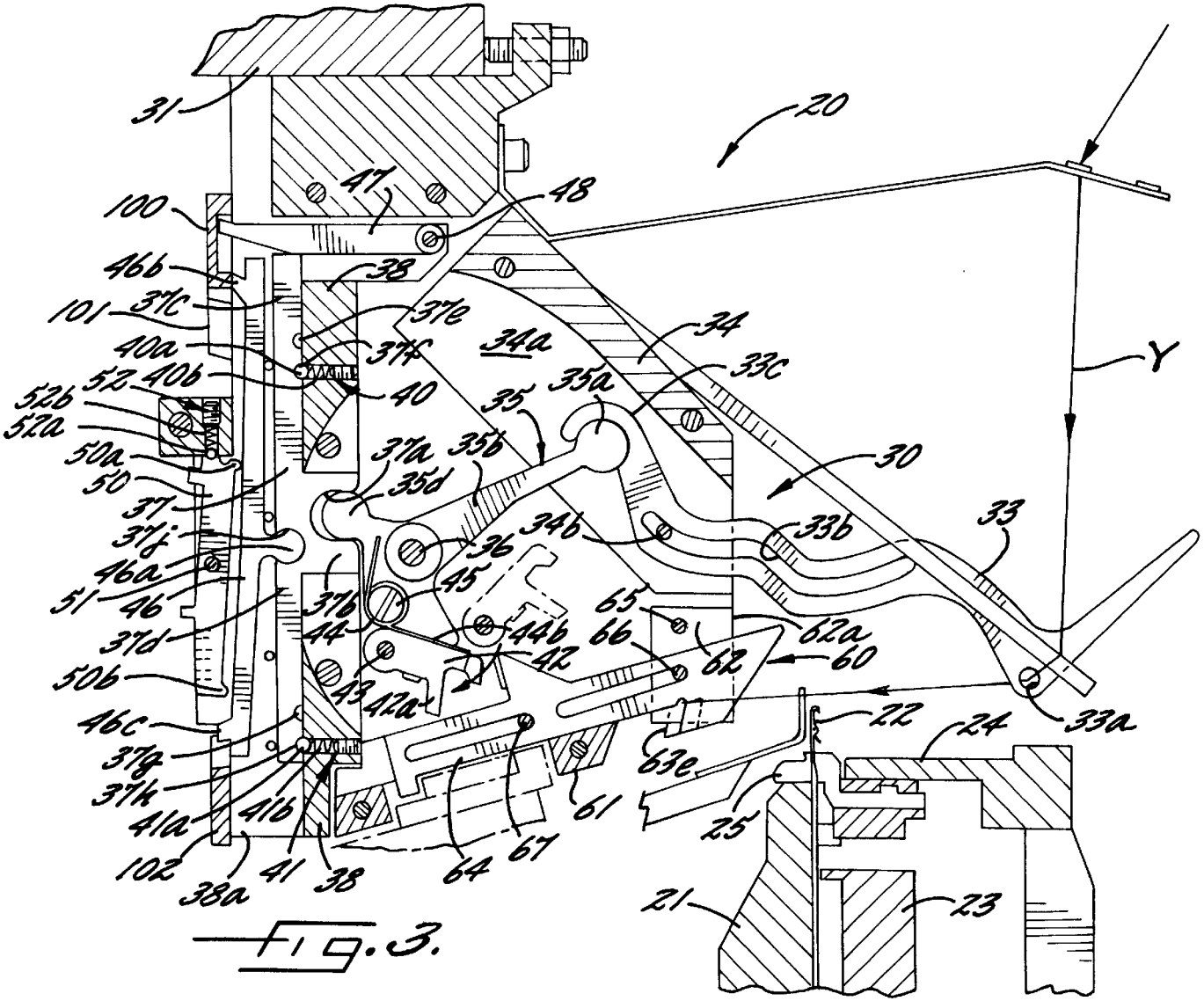
FIG. 3 is a view similar to FIG. 2 showing the yarn feeding finger in its most advanced position beyond its operative position.
Figure 4:
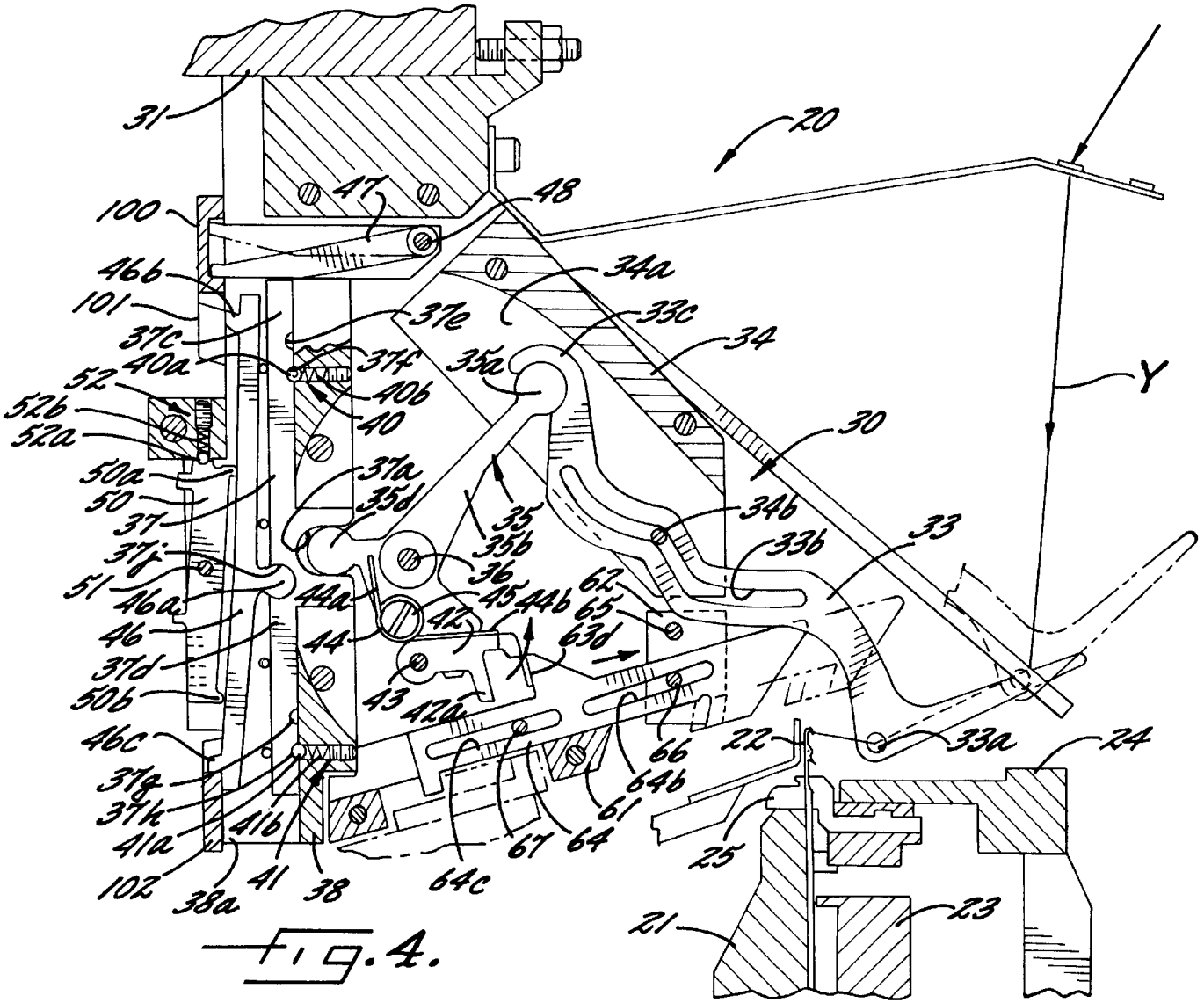
FIG. 4 is a view similar to FIG. 3 illustrating the yarn feeding finger in its operative position.

Each second rocking jack 46 has a lowering butt 46*b* on the side thereof opposite the projecting ball 46*a* and adjacent the upper end thereof and a raising butt 46*c* on the same side adjacent the lower end thereof. Each second rocking jack 46 is retained in groove 38*a* for vertical sliding movement depending upon the desired position of the yarn feed finger 33. When the second rocker jack 46 is rocked clockwise, as seen in FIG. 2, the lower end thereof and raising butt 46*c* is moved outwardly into the path of a raising cam 102 (FIG. 3) which raises second rocking jack 46 upwardly. Such upward movement also moves slider member 37 upwardly and thereby moves second arm 35*c* of first rocking jack 35 upwardly. First rocking jack 35 pivots clockwise and by arm 35*b* and ball 35*a* moves yarn feed finger 33 outwardly from the inoperative position to the extended position and then back to the operative position. Counterclockwise rocking of second rocking jack 46 retracts raising butt 46*c* and extends lowering butt 46*b* into the path of a lowering cam 101 (FIG. 2). Second rocking jack 46 is moved downwardly, as is slider member 37. Second arm 35*c* is moved downwardly pivoting first rocking jack 35 counterclockwise and thusly retracting the yarn feed finger 33 from the operative position to the inoperative position.

Above each slider member 37 is an action lever member 47 mounted for pivotal movement about a pin 48. As the slider member 37 is moved upwardly by the second rocking jack 46, the upper end of the slider member engages the lever member 47 and pivots it upwardly which moves the yarn feed finger 33 to the extended position. Thereafter, the lowering cam 101 pivots the lever member 47 downwardly which lowers the slider member 37 a sufficient distance to retract the yarn feed finger 33 from the extended position to the operative position.

Figure 5:
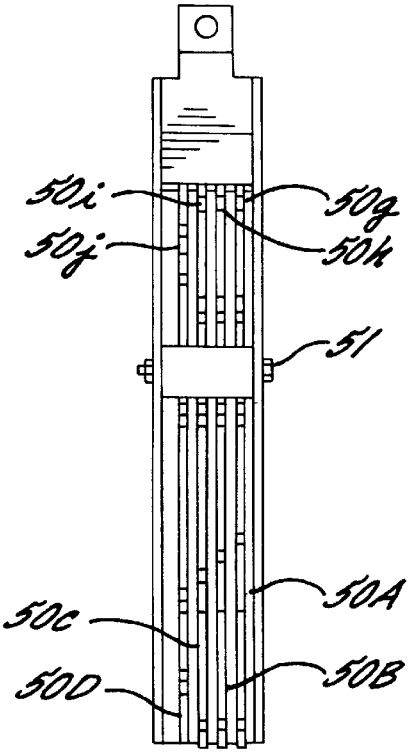
FIG. 5 is a front elevational view showing the yarn finger selection members of the yarn feeding and changing mechanism shown in FIGS. 1–4.

A selection member 50 is provided for each yarn feed finger 33 and is mounted for pivotal movement by a pin 51 on the slider guide member 38 inside of and adjacent the second rocking jack 46. The upper and lower ends have outwardly expending projections 50*a* and 50*b* for engagement with the second rocking jack 46 above and below the ball 46*a* so that as selection member 50 pivots, second rocking jack 46 will be rocked. As best illustrated in FIG. 5, in this embodiment, there are four selection members 50A, 50B, 50C and 50D. The lower part of each of the selection members 50A, 50B, 50C and 50D is provided with a selection butt 50*c*, 50*d*, 50*e* and 50*f*, respectively. The upper part of each of the selection members 50A, 50B, 50C and 50D is provided with a cancelling butt 50*g*, 50*h*, 50*i* and 50*j*, respectively.

The upper end of each selection member has a pair of cavities 50*k* and 50*m* for receipt of a ball 52*a* of a detent 52 which also includes a spring 52*b*. The detent 52 releasably holds the selection member 50 in the cancelled position or in the selection position depending on which of the cavities 50*k* or 50*m* in which the ball 52*a* is positioned.

Figure 6:
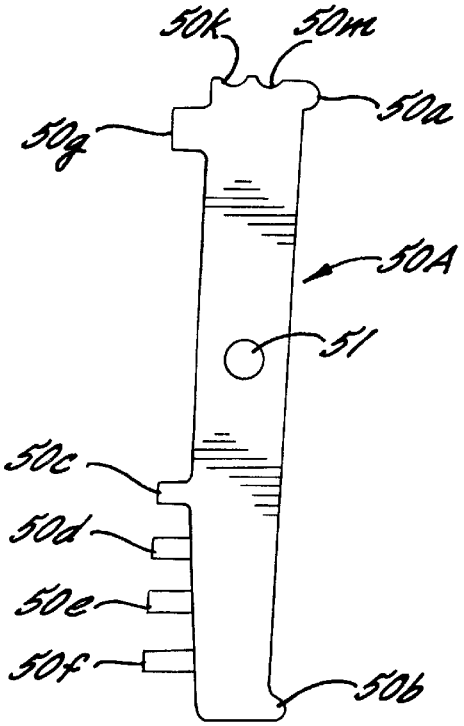
FIG. 6 is a side elevational view showing the selection members removed from the arrangement shown in FIG. 5.

The yarn feeding and changing mechanism 30 further includes a yarn end catching and cutting means 60 (FIGS. 2 and 6). Means 60 includes a guide member 61 having four grooves 61*a*, 61*b*, 61*c* and 61*d* therein. A fixed blade 62 is positioned between a movable blade 63 and a yarn holder 64. Fixed blade 62 is fixed by two pins 65 and 66 on the yarn feed finger guide member 34 and has a cutting edge 62*a*.

Figure 7:
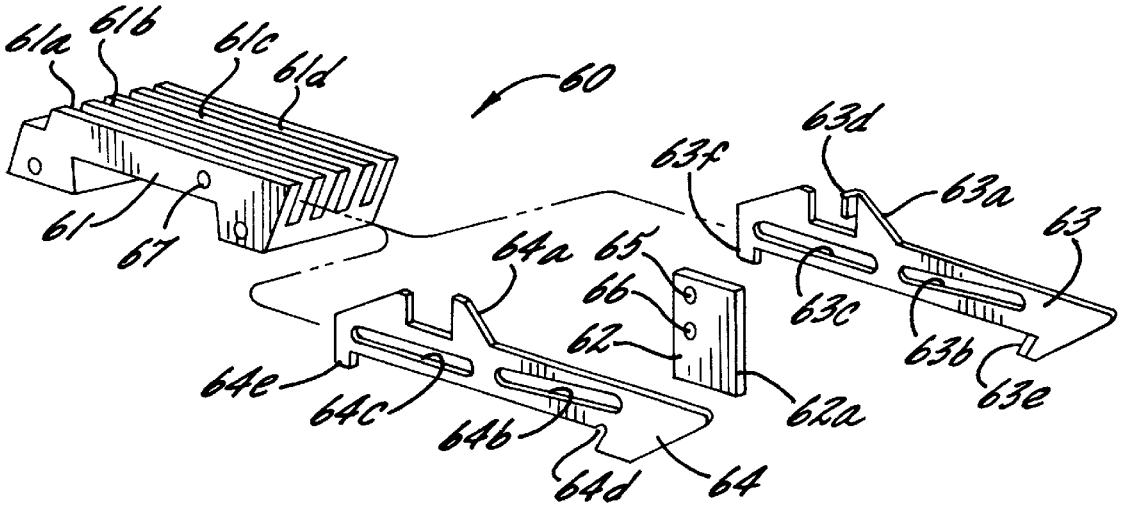
FIG. 7 is a fragmentary exploded perspective view illustrating the yarn catching and cutting mechanisms.

The movable blade 63 has an upwardly extending projection 63*a* thereon and first and second elongate slots 63*b* and 63*c* therein. Pin 66 which fixes blade 62 is positioned in slot 63*b* and a pin 67 extending through the grooves 61*a*, 61*b*, 61*c* and 61*d* in guide member 61 is positioned in slot 63*c* to hold blade 63 in position as it is moved outwardly and inwardly. The projection 63*a* on movable blade 63 has a tip 63*d* that is bent at a right angle to the remainder of the projection 63*a* and extends toward the yarn holder 64 (FIG. 7). Movable blade 63 has a blade portion 63*e* that cooperates with blade portion 62*a* to cut the yarn Y.

Yarn holder 64 has an upwardly extending projection 64*a* that is positioned in the path of tip 63*d* of projection 63*a* on the movable blade 63 so that the movable blade 63 and yarn holder 64 move together. Yarn holder 64 has a first elongate slot 64*b* through which pin 66 penetrates and an elongate slot 64*c* through which pin 67 penetrates. The yarn holder 64 has a yarn catching portion 64*d* for catching the yarn Y.

Movable blade 63 and yarn holder 64 are provided on the bottom side of their ends opposite the blade portion 64*e* and the yarn holder 64*d* with action butts 63*f* and 64*e*. The movable blade 63 and yarn holder 64 are moved by a selection means 70.

Selection means 70 is carried by a rotating holding member 71 mounted on circular member 32. An L-shaped bracket 72 is mounted on rotating holding member 71 by a plate member 73 and moves therewith. A plate member 74 is mounted on the vertical leg of bracket 72 and extends downwardly therefrom. A first horizontal block 75 is carried by the lower end of plate member 74 and a second horizontal block 76 is carried by plate member 74 in a medial portion thereof (FIG. 1). An inverted L-shaped block 77 is carried by plate member 74 near the upper end thereof.

First horizontal block 75 has an arm 78 extending outwardly therefrom and a rotating cam means, generally indicated at 80, is mounted on the outer end thereof (FIG. 1). Cam means 80 includes a cam block 81 fixed to arm 78 and which moves in the direction of the arrow in FIG. 8. An alignment cam 82 is mounted on cam block 81 and has a first inward slanting surface 82*a*, a slightly outward slanting surface 82*b* and a second inward slanting surface 82*c*. A guiding cam 83 is mounted on cam block 81 immediately downstream from the alignment cam 82 and has an outward slanting surface 83*a* and a straight surface 83*b*. Downstream of guiding cam 83, a triangular advancing cam 84 inside and a retreating or withdrawing cam 85 having an inward slanting surface 85*a* are also mounted on cam block 81.

Figure 8:
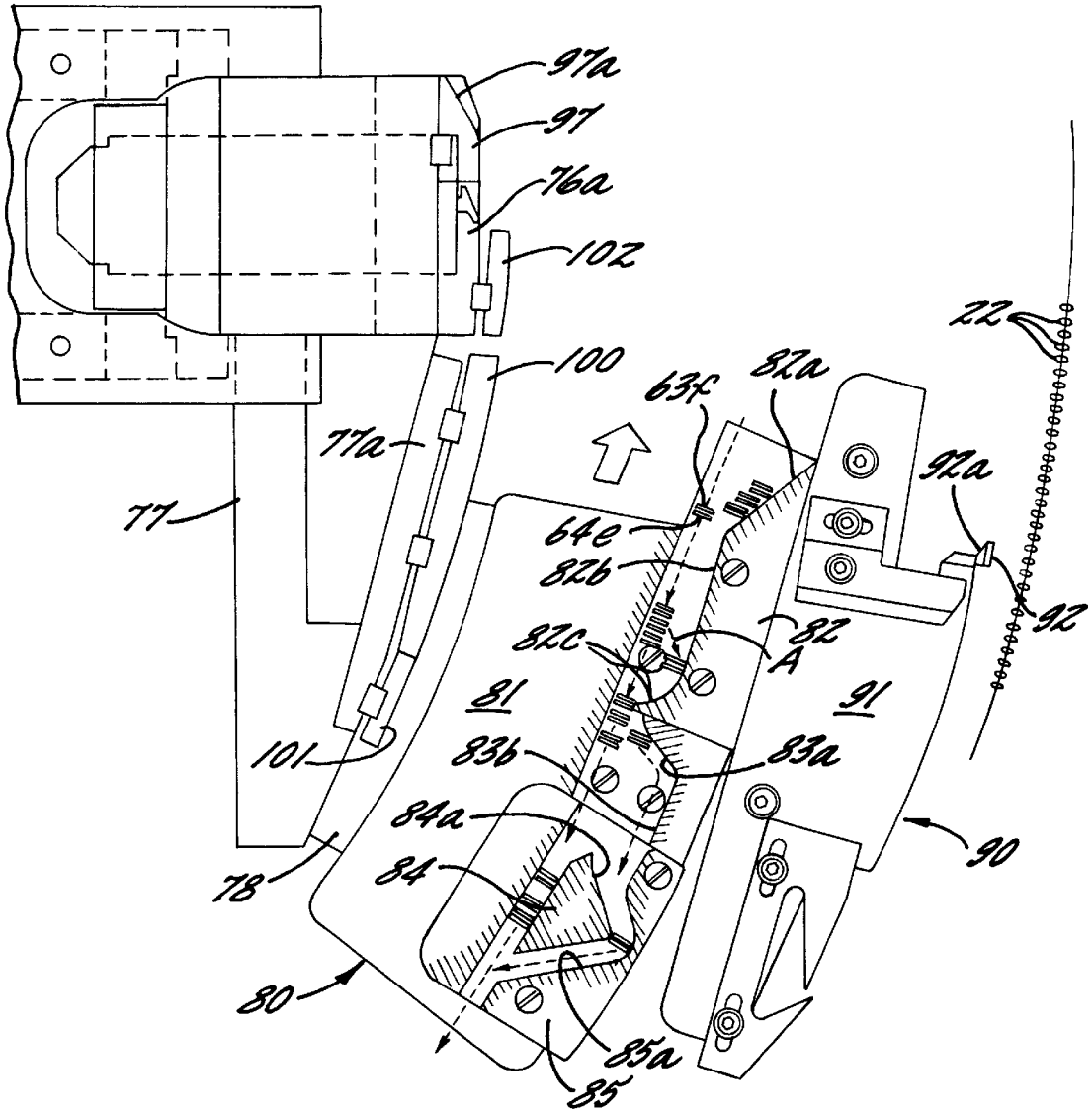
FIG. 8 is a fragmentary plan view of the yarn changing mechanism of the present invention.

As cam means 80 rotates in the direction of the arrow in FIG. 8, the action butts 63*f* and 64*e* on the movable blade 63 and the yarn holder 64 travel along the cam track of alignment cam 82 and advance the movable blade 63 and the yarn holder 64 while the yarn feed finger 33 is returning to the operative position inward from the extended position (dotted arrow A in FIG. 8) thereby releasing the yarn end that was previously cut and that has been held between the yarn holder 64 and the fixed blade 62. Upon further rotation, action butts 63*f* and 64*e* engage inward slanting surface 82*c* of alignment cam 82 and are returned thereby to alignment with the action butts of the other movable blades 63 and yarn holders 64. In the meantime, the yarn end that was released is caught by the needles 22 and knit into the knit fabric.

The movable blade 63 and the yarn holder 64 that were moved inwardly by engagement of their action butts 63*f* and 64*e* with the inward slanting surface 82*c* of alignment cam 82 engage the claw tip 42*a* of the claw 42 when the yarn feed finger 33 is moved from the operative position to the inoperative position and the movable blade 63 and yarn holder 64 are advanced such that the action butts 63*f* and 64*e* move along the outward slanting part 83*a* of guiding cam 83 (FIG. 8).

Thereafter, butts 63*f* and 64*e* move along the straight surface 83*b* until they engage the outward slanting surface 84*a* of advancing cam 84. Outward slanting surface 84*a* further advances the action butts 63*f* and 64*e* and thus the movable blade 63 and yarn holder 64 until the action butts 63*f* and 64*e* engage and are moved by the inward slanting surface 85*a* of retreating or withdrawing cam 85 and thus withdraw the movable blade 63 and yarn holder 64. As they withdraw or retreat, the movable blade 63 and yarn holder 64 catch the yarn Y in the openings between the movable blade 63, the yarn holder 64 and the fixed blade 62. Further withdrawal thereof causes the movable blade 63 and the fixed blade 62 to cut the yarn Y and the yarn holder 64 to press the cut end portion of the yarn against the fixed blade 62 to hold the free end of the yarn.

A yarn catching means, generally indicated at 90, is mounted on the cam block 81 mounted on the rotating arm 75 by a mounting block 91. Yarn catching means 90 includes an upright yarn catching member 92 for engaging and catching yarn at different positions of the yarn feed finger 33. Yarn catching member 92 has a downward slanting surface 92*a* for engaging the yarn when the yarn feed finger 33 moves from the inoperative position to the operative position and pushing the yarn down into position to be caught by needles 22.

The selection means 70 will now be described and its mode of operation explained. As previously described, selection means 70 is mounted on depending plate 74 and rotates synchronously with the needle cylinder 21. Selection means 70 includes an inner section, generally indicated at 93, and an outer section, generally indicated at 95 (FIG. 1). Outer section 95 of selection means 70 includes four selection fingers 96A, 96B, 96C and 96D.

Figure 9:
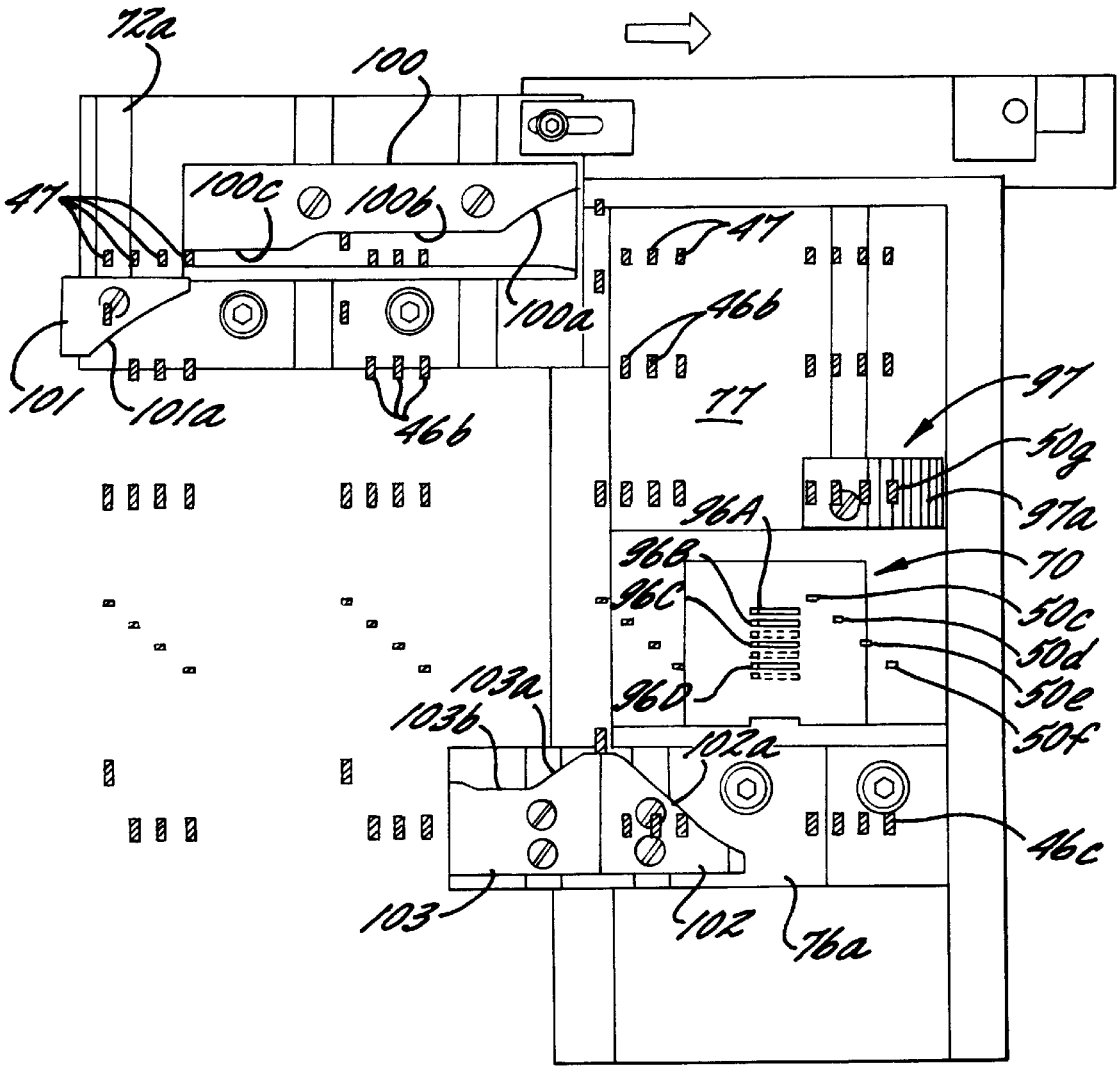
FIG. 9 is a sectional view taken substantially along line 9—9 in FIG. 1.

The selection means 70 is illustrated more completely in FIGS. 8 and 9 and includes a cancelling cam 97 mounted on an outside rim 77*a* of block 77. Cancelling cam 97 has a slanting surface 97*a* which engages the cancelling butt 50*g* of selection member 50 and presses inward all of the selection members 50. A lever cam 100 is also mounted on rim 77*a* and includes a slanting surface 100*a* that engages the tip of action lever members 47 that have been raised by the slider members 37 and pushes such lever members 47 downwardly. Lever cam 100 also has first and second horizontal guiding surfaces 100*b* and 100*c*. Finally, a lowering cam 101 is also mounted on rim 77*a* and includes a slanting surface 101*a* for engaging the lowering butt 46*b* on each of the second rocking jacks 46.

A raising cam 102 is mounted on an outside rim 76*a* of second mounting block 76 and has an upwardly slanting surface 102*a* for engaging the raising butt 46*c* on each second rocking jack 46. A receiving cam 103 is mounted to the left of raising cam 102 which has a downwardly slanting surface 103*a* for a short distance and a horizontal guiding surface 103*b*. Receiving cam 103 receives the butt 46c from raising cam 102 and restrains the downward movement of the second rocking jack 46 and the sliding members 37 when the lever member 47 is lowered by the lever cam 100.

Selection of the yarn feed fingers 33 and thus the particular yarn to be knit into the fabric is performed by the four selection fingers 96A, 96B 96C and 96D acting on the selection members 50. The four selection fingers 96A, 96B, 96C and 96D are actuated by yarn changing information stored in the memory inside a controller (not shown). Such memory may be in the form of magnetic tapes, floppy disks, magnets optical disks, IC memories, card memories or any other information storage means.

The selection butts 50*c*, 50*d*, 50*e* and 50*f* are arranged on different levels. When the yarn feed fingers 33 are in the inoperative position, the selection butts 50*c*, 50*d*, 50*e* and 50*f* are arranged to correspond to the respective levels of the four selection fingers 96A, 96B, 96C and 96D. Normally, the selection fingers 96B, 96B, 96C and 96D are arranged face down and the four selection butts 50*c*, 50*d*, 50*e* and 50*f* are sufficiently spaced vertically. When a particular yarn is selected by the controller, the corresponding selection finger 96A, 96B, 96C or 96D engages the corresponding butt 50*c*, 50*d*, 50*e* or 50*f* and presses the lower portion of the corresponding selection member 50 inwardly.

In operation, the cancelling butts 50*g* on the selection members 50 engage the cancelling cam 97 continuously regardless of whether all four of the yarn feed fingers 33 are in the operative position or the inoperative position. When a particular yarn is selected and the corresponding action butts 50*c*, 50*d*, 50*e* or 50*f*, for example action butt 50*c*, is actuated to pass over the corresponding selection finger 96A, the raising butt 46*c* of the second rocking jack 46 aligned with the selected selection member 50 engages the raising cam 102 and the second rocking jack 46 and its connected slider member 37 are raised upwardly. The slider member 37 contacts its associated lever member 47 and pivots it upwardly. The selected yarn feed finger 33 is thusly moved to the extended position. Thereafter, the lever member 47 is moved to its operative position by lever cam 100, thereby moving yarn feed finger 33 from the extended position to the operative position. At the same time, the lowering butt 46*b* on the second rocking jack 46 passes in front of the lowering cam 101.

The other three selection fingers 96B, 96C and 96D are placed in the upper or inoperative position and the corresponding raising butts 46C on the other three second rocking jacks 46 are pushed in and pass in front of raising cam 102. After that, the lowering butts 46*b* of the other three second rocking jacks pass under the lower edge of lowering cam 101 and the yarn feed fingers 33 remain in the inoperative position. So long as the corresponding yarn feed finger 33 is maintained in the operative position, the selection finger 96A will not engage the action butt 50*c* and the yarn feed finger 33 is not moved.

When it is desired to move the yarn feed finger 33 from the operative position to the inoperative position, the selection finger 96A is caused to engage the action butt 50*c* and to move the raising butt 46*c* on the second rocking jack 46 out of the path of the raising cam 102 and the lowering butt 46*b* into the path of the lowering cam 101. The second rocking jack 46 and its associated slider member 37 are moved downwardly and the yarn feed finger 33 is retracted to the inoperative position by first rocking jack 35.

Figure 10:
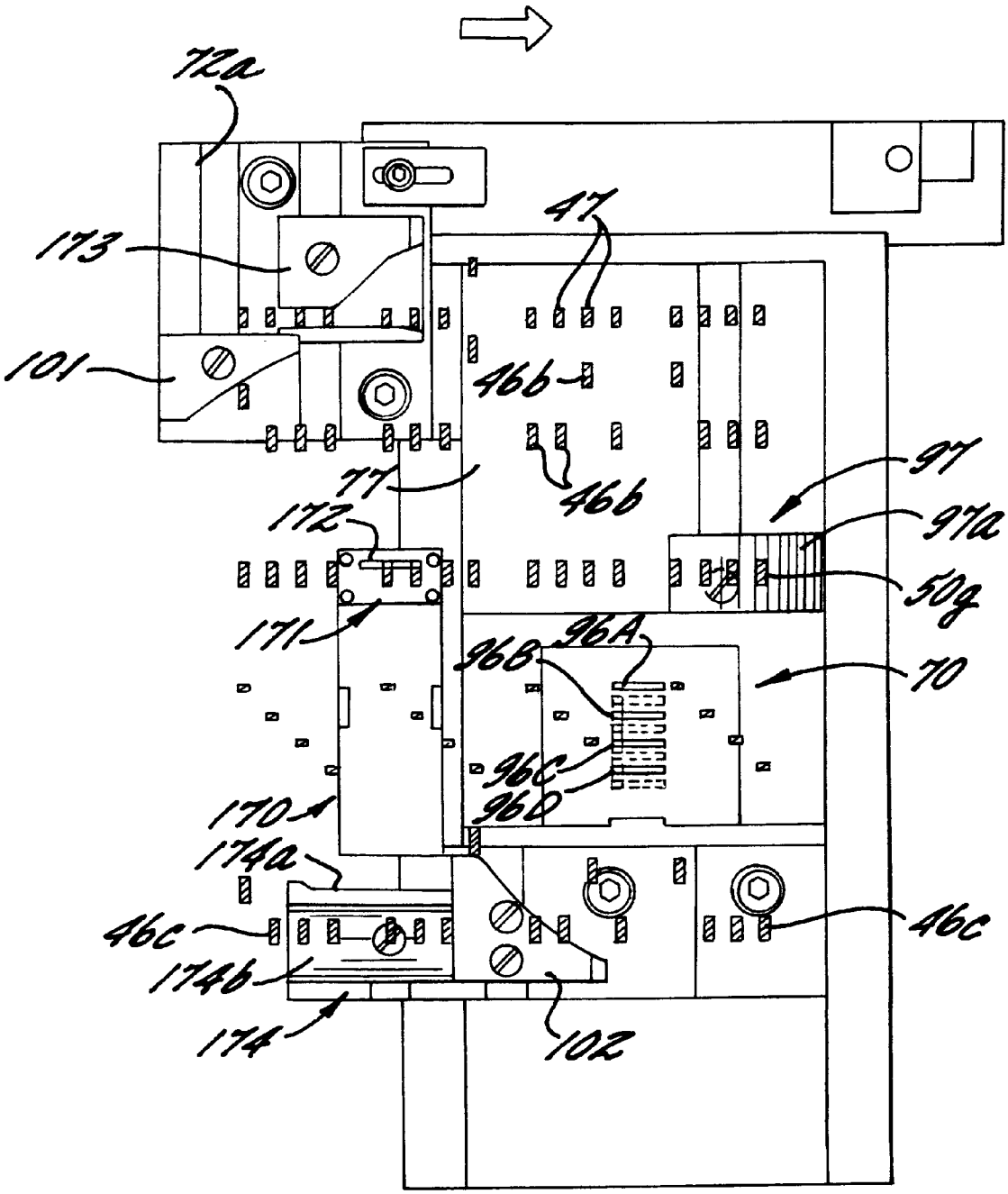
FIG. 10 is a view similar to FIG. 9 of a different portion of the selection unit illustrated in FIG. 9.

Referring now to FIG. 10, there is illustrated a cancelling means 170 and the selection means 70 of the present invention. These means maintain all of the yarn feed fingers 33 in the same condition regardless of whether they are in the operative position or the inoperative position when the same pattern is to be repeated.

In addition to the selection means 70 (shown in FIG. 9), the cancelling means 170 is also shown in FIG. 10 and is controlled by applying signals of appropriate polarity to a switching means (not shown) of the controller (not shown). Cancelling means 170 is located downstream from the selection means 70. Between the bracket 72 (FIG. 1) and the inner section 93, a driving means 171 including a vertically moving cancelling finger 172 is provided. The cancelling finger 172 is located at a level that is within the height of the cancelling cam 97. A lever cam 173 corresponds to lever cam 100 except that it is horizontally shortened and a receiving cam 174 corresponds to receiving cam 103 except that its upper surface 174*a* does not have a downwardly slanting surface. The receiving cam 174 has a concave front face 174*b* for receiving the raising butts 46*c* when the second rocking jacks 46 are rocked inwardly.

In operation, the cancelling cam 97 is located immediately in front of the selection means 70 and pushes all of the cancelling butts 50*g* of the selection members 50 outward which makes all of the selection butts 50*c*, 50*d*, 50*e* and 50*f* move inwardly. In the selection means 70, all of the selection fingers 96A, 96B, 96C and 96D are positioned upward according to the pattern information from the controller (not shown). The selection fingers 96A, 96B, 96C and 96D engage all of the selection butts 50*e*, 50*d*, 50*e* and 50*f* and push the same outward. The raising butts 46*c* of the second rocking jacks 46 corresponding to the yarn feed fingers 33 in the operative position will thus pass the front of the raising cam 101 and will maintain the high level as before. The raising butts 46*c* of the second rocking jacks 46 corresponding to the yarn feed fingers 33 in the inoperative position will pass the front of the raising cam 101 thereby maintaining the low level as before.

Next, the cancelling fingers 172 of the cancelling means 170 push all of the cancelling butts 50*g* outward again and position all of the selection butts 50*c*, 50*d*, 50*e* and 50*f* inward in preparation for the next selection. At this time, the lower end portion of the second rocking jack 46 corresponding to the yarn feed finger 33 in the inoperative position also rocks inward and moves the raising butt 46*c* into the concave face 174*b* of the receiving cam 174 and the lowering butt 46*b* passes the front of the lowering cam 101. As a result, the yarn feed finger 33 in the operative position remains there and the yarn feed finger 33 in the inoperative position also remains there.

In the drawings and specifications, there has been set forth a preferred embodiment of the invention, and although specific terms are employed, they are used in a generic and descriptive sense only and not for purposes of limitation, the scope of the invention being set forth in the following claims.

That which is claimed:

1. In a circular knitting machine having a rotating needle cylinder and a plurality of knitting needles mounted for vertical sliding movement in vertical grooves around the periphery of the needle cylinder, the improvement comprising yarn feeding and changing means for selectively feeding a plurality of different yarns to the needles and for changing such yarns in accordance with a predetermined pattern without generating waste lengths of yarn, said yarn feeding and changing means comprising:

a plurality of yarn feed fingers selectively movable between an inoperative position inwardly of the needles and in which said yarn feed fingers do not feed yarns to the needles, an operative position in operative association with the needles and in which said yarn feed fingers feed yarns to the needles, and an extended position on the opposite side of said operative position from said inoperative position and outwardly of the needles, means for moving any of said yarn feed fingers which are in the operative position to the inoperative position when the pattern dictates a change in the yarn being fed to the needles, means for catching the yarn being fed to the needles by any yarn finger being moved from the operative position to the inoperative position and for cutting the yarn relatively close to the needles to form a short trailing end portion on the yarn previously knit into fabric by the needles and a free end portion of the yarn on said yarn feed finger, said catching and cutting means being movable between operative and inoperative positions, said catching and cutting means including yarn holding means for holding the free end of the yarn while said yarn feed finger is in said inoperative position and until said yarn feed finger again begins to feed yarn to the needles, and means for moving a selected yarn feed finger from the inoperative position to the extended position outwardly of said needles while moving said yarn holding means to a position to present the held free end portion of the yarn to the needles for knitting of such free end portion into the fabric and for moving said yarn feed finger from the extended position to the operative position while causing said yarn holding means to release the held end of the yarn, whereby all of the yarn is knitted into the fabric and no cut lengths of yarn are generated as waste.

2. A circular knitting machine according to claim 1 wherein said yarn feed fingers are moved outwardly and downwardly from the inoperative position to the operative position and inwardly and upwardly from the operative position to the inoperative position along a predetermined path of travel.

3. A circular knitting machine according to claim 2 wherein each of said yarn feed fingers has an elongate profiled guide slot therein and a stationary guide pin penetrates through said guide slot to cause said yarn feed finger to follow said predetermined path of travel in its movement between said positions.

4. A circular knitting machine according to claim 1 wherein said yarn feed fingers are mounted for reciprocating movement along the predetermined path of travel adjacent to each other and each includes a guide eyelet through which the yarn passes as it is fed to the needles.

5. A circular knitting machine according to claim 4 wherein said means for moving each of said yarn feed fingers between said inoperative position and said operative position includes a first rocking jack for each yarn feed finger mounted for pivotal movement and connected to its corresponding yarn feed finger, and selection means for selectively rocking said first rocking jack for moving said yarn feed finger between said positions.

6. A circular knitting machine according to claim 5 wherein said selection means rotates synchronously with the needle cylinder and includes a plurality of selection finger, one for each first rocking jack, for causing rocking movement of said first rocking jack.

7. A circular knitting machine according to claim 6 wherein said first rocking jacks are connected to a plurality of slider members, one for each first rocking jack, mounted for reciprocation in directions to cause rocking movement of said first rocking jack.

8. A circular knitting machine according to claim 7 wherein said slider members are connected to a plurality of second rocking jacks, one for each slider member, which in turn are mounted for both pivotal and reciprocating movement.

9. A circular knitting machine according to claim 8 including a plurality of selection members, one for each second rocking jack, mounted for pivotal movement adjacent said second rocking jacks for causing rocking movement of said second rocking jacks upon pivotal movement of said selection members.

10. A circular knitting machine according to claim 9 wherein each of said selection members has an action butt thereon adapted to be positioned in the path of one of said selection fingers for causing rocking movement of said second rocking jacks in one direction.

11. A circular knitting machine according to claim 10 wherein each of said selection members has a cancelling butt thereon and wherein said rotating selection means includes a cancelling cam for engaging said cancelling butts to pivot all of said selection members to prepare said selection members for selection by said selection fingers.

12. A circular knitting machine according to claim 11 wherein each of said second rocking jacks has a lowering butt at one end thereof and a raising butt at the other end thereof, said lowering butt and said raising butt being movable between active and retracted positions depending upon the direction of rocking movement of said second rocking jacks.

13. A circular knitting machine according to claim 12 wherein said rotating selection means includes a lowering cam for engaging said lowering butts on said second rocking jacks when in the active position for lowering said second rocking jacks and a raising cam for engaging said raising butts on said second rocking jacks when in the active position to raise said second rocking jacks.

14. A circular knitting machine according to claim 7 including a plurality of action levers, one for each slider member, pivotally mounted above said slider members for engagement thereby upon upward sliding movement to extend the movement of said yarn feed fingers beyond the operative position to the extended position.

15. A circular knitting machine according to claim 14 wherein said rotating selection means includes a lever cam engageable with said action levers to move said raised action levers downwardly a distance sufficient to retract said yarn feed fingers from the extended position to the operative position.

16. A circular knitting machine according to claim 13 including a rotating cancelling means located downstream of said selection means for maintaining said yarn feed fingers in the same condition when the same pattern is to be repeated.

17. A yarn feeding and changing mechanism for a circular knitting machine having a rotating needle cylinder and knitting needles carried by the needle cylinder for knitting yarns into fabric, said mechanism comprising a plurality of yarn feed fingers selectively movable along a predetermined path of travel between operative, inoperative and extended positions, said yarn feed fingers being adapted to feed yarn to the needles when in the operative position and not to feed yarn to the needles when in the inoperative position, means for moving selected yarn feed fingers between the operative and inoperative positions in accordance with a predetermined pattern, means for catching a yarn being fed by a yarn feed finger in the operative position when said yarn feed finger is selected for movement to the inoperative position and for cutting the caught yarn, said catching means including yarn holding means for holding the cut free end of the yarn as said yarn feed finger moves from the operative position to the inactive position and while said yarn feed finger is in the inoperative position, and selection means for causing said yarn moving means to move a selected other of said yarn feeding fingers along said predetermined path of travel to an extended position beyond the operative position and outwardly of the needles to present the held free end portion of the yarn so that it can be caught by the needles for knitting into a fabric rather than being cut to form waste.

18. A yarn feeding and changing mechanism according to claim 17 wherein said selection means also causes said yarn holding means to release the free end of the yarn as said yarn feed finger is moved from the extended position to the operative position.

19. A yarn feeding and changing mechanism according to claim 18 wherein each of said yarn feed fingers has an elongate, profiled guide slot therein and a stationary guide pin penetrates through said guide slot to cause said yarn feed finger to follow said predetermined path of travel in its movement between said positions.

20. A yarn feeding and changing mechanism according to claim 19 wherein said yarn finger moving means includes a first rocking jack for each yarn feed finger mounted for pivotal movement and connected to its corresponding yarn feed finger.

21. A yarn feeding and changing mechanism according to claim 20 wherein said yarn feed finger moving means further includes a plurality of slider members, one for each first rocking jack, mounted for reciprocation and connected to said first rocking jacks for causing rocking movement of said first rocking jacks upon reciprocation of said slider members.

22. A yarn feeding and changing mechanism according to claim 21 wherein said yarn feed finger moving means further includes a plurality of second rocking jacks, one for each slider member, also mounted for both pivotal and reciprocating movement and having a lowering butt at the upper end thereof and a raising butt at the lower end thereof.

23. A yarn feeding and changing mechanism according to claim 22 including a plurality of selection members, one for each second rocking jack, mounted for pivotal movement adjacent said second rocking jacks for causing rocking movement of said rocking jacks upon pivotal movement thereof.

24. A yarn feeding and changing mechanism according to claim 23 wherein said selection means includes a plurality of selection fingers, one for each yarn feeding member, for engaging selected ones of said selection members in accordance with said predetermined pattern to cause changing of the yarns being fed to the needles.

25. A yarn feeding and changing mechanism according to claim 24 wherein said selection means further includes cam means for causing reciprocation of said second rocking jacks in response to said selection fingers and selection members to thereby cause movement of said yarn feeding fingers between said positions.

* * * * *